US007010924B2

(12) United States Patent
Kempiak

(10) Patent No.: US 7,010,924 B2
(45) Date of Patent: Mar. 14, 2006

(54) REAR LOAD REFRIGERATED DISPLAY CASE

(75) Inventor: Michael J. Kempiak, Osceola, IN (US)

(73) Assignee: Carrier Commercial Refrigeration, Syracuse, NY (US)

( * ) Notice: Subject to any disclaimer, the term of this patent is extended or adjusted under 35 U.S.C. 154(b) by 250 days.

(21) Appl. No.: 10/254,291

(22) Filed: Sep. 25, 2002

(65) Prior Publication Data

US 2004/0055321 A1 Mar. 25, 2004

(51) Int. Cl.
*A47F 3/04* (2006.01)

(52) U.S. Cl. ..... 62/89; 62/255; 62/256
(58) Field of Classification Search ..... 62/255, 62/256
See application file for complete search history.

(56) References Cited

U.S. PATENT DOCUMENTS 2,962,875 A * 12/1960 Barroero ..... 62/256
2,984,085 A * 5/1961 Rainwater ..... 62/256
3,119,241 A * 1/1964 Wile ..... 62/254
3,168,818 A * 2/1965 Weber ..... 62/256
3,218,822 A * 11/1965 Bentley et al. ..... 62/256
4,117,697 A * 10/1978 Myers et al. ..... 62/256
4,124,996 A * 11/1978 Kennedy et al. ..... 62/256
4,299,099 A * 11/1981 Myers et al. ..... 62/256
5,097,673 A * 3/1992 Negishi ..... 62/256
5,502,979 A * 4/1996 Renard ..... 62/256
6,145,327 A * 11/2000 Navarro ..... 62/89

* cited by examiner

*Primary Examiner*—William E. Tapolcai
(74) *Attorney, Agent, or Firm*—Carlson, Gaskey & Olds

(57) ABSTRACT

A refrigerated display case reduces the temperature of refrigerated items in the front of the case and achieves a tighter temperature range within the case. Air drawn from a cooler is further cooled by a coil. Some of the cold air is discharged along the front of the case as an air curtain is and drawn by fans back into the cooler. The remaining cold air is directed to a duct in the rear of the case. Openings in the duct allow air to flow across the refrigerated items towards the front of the case, further reducing the temperature of the refrigerated items in the front of the case. To prevent refrigerated items in the rear of the case from freezing, air entering the duct is warmed with air that bypasses the coil.

16 Claims, 2 Drawing Sheets

REAR LOAD REFRIGERATED DISPLAY CASE

BACKGROUND OF THE INVENTION

The present invention relates generally to a rear load refrigerated display case which provides additional cooling of refrigerated items at the front of the case and prevents freezing of refrigerated items at the rear of the case.

Refrigerated display cases are employed to allow shoppers to access groceries and other refrigerated items from the front of the case without the obstruction of a door. The refrigerated items are stocked from the rear of the case to allow restocking of the case without interruption of customer traffic. The temperature range in the case is generally between 32° F. and 43° F.

A walk-in cooler adjacent to the rear of the case maintains freshness of the refrigerated items prior to being stocked in the case. A divider, such as a curtain, typically separates the rear of the refrigerated case from the cooler.

In the prior art refrigerated display case, air drawn from the cooler is further cooled by a coil and discharged along the front of the case to create an air curtain that cools the front refrigerated items and is then circulated back to the cooler. Some of the air cooled by the coil drops down the rear of the case and/or is deflected towards the front of the case to cool the refrigerated items at the top of the case.

A drawback of the refrigerated display case of the prior art is that the refrigerated items in the rear of the case are colder than the refrigerated items in the front of the case. This is because the rear of the case shares a wall with the cooler and the front of the case is open to the warmer store environment. Therefore, there is a large temperature range in the case. Additionally, the refrigerated items in the middle front of the case are generally warmer because of a loss in the air curtain integrity.

SUMMARY OF THE INVENTION

The refrigerated display case of the present invention reduces the temperature of the refrigerated items in the front of the case and achieves a tight temperature range within the case. Air from a walk-in cooler adjacent to the rear of the case is drawn into the case and cooled by a coil.

Some of the cooled air is discharged along the front of the case as an air curtain, cooling the refrigerated items in the front of the case. The air from the air curtain is drawn by fans at the bottom of the case for circulation back into the cooler. The remaining air cooled by the coil in the case is directed to a duct in the rear of the case. The duct has openings along the length of the duct that allow cool air to flow across the refrigerated items towards the front of the case. As the cooled air moves to the front of the case and passes over the refrigerated items, the refrigerated items in the case are cooled. Additionally, this cooled air assists in reducing the temperature of the refrigerated items in the front of the case by supporting the air curtain.

The air in the duct is generally colder than the air in the air curtain as the duct is proximate to the cooler and away from the warmer store environment. To prevent the refrigerated items in the rear of the case from freezing, air entering the duct is warmed with air from the cooler that bypasses the coil.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawing that accompany the detailed description can be briefly described as follows.

DETAILED DESCRIPTION OF THE PREFERRED EMBODIMENT

Figure 1:
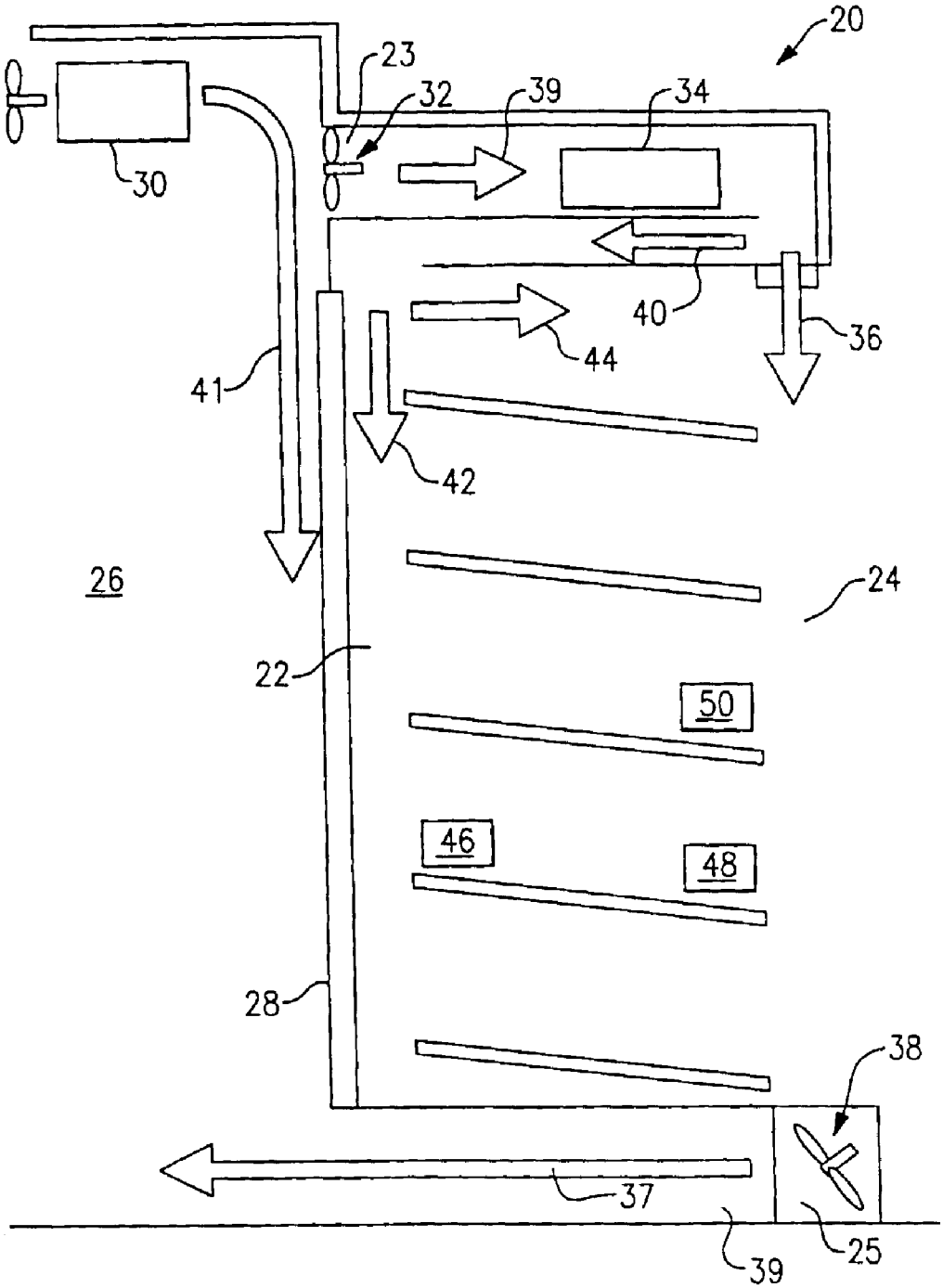
FIG.1 Prior Art
FIG. 1 schematically illustrates a prior art refrigerated display case.

FIG. 1 schematically illustrates a prior art rear load refrigerated display case 20. Refrigerated items are stocked into the case 20 from the rear 22, allowing customers to access the refrigerated items from the front 24 of the case 20. The rear 22 of the case 20 is adjacent to a walk-in cooler 26 that keeps the refrigerated items fresh prior to being stocked into the case 20. A divider 28 separates the rear 22 of the case 20 and the cooler 26. In one example, the divider 28 is a plastic curtain. The temperature range in the case 20 is between 32° F. and 43° F.

Air 41 circulated in the cooler 26 is cooled by a first coil 30 to maintain the desired temperature. Air from the cooler 26 is drawn into the top 23 of the case 20 by fans 32 located at the top 23 and in the rear 22 of the case 20. Once the air 39 has entered the case 20, the air 39 is further cooled by a second coil 34.

Some of the cold air leaving the second coil 34 is discharged along the front 24 of the case 20, creating an air curtain 36 that cools the refrigerated items in the front 24 of the case 20. Fans 38 at the bottom 25 and front 24 of the case 20 draw air from the air curtain 36 into a return duct 39 for return of the air 37 to the cooler 26. The remaining air 40 from the second coil 34 is channeled under the second coil 34 and discharged at the rear 22 of the case 20. The cold air drops down the inner rear 42 of the case 20 and/or is deflected towards the front 24 of the case 20.

In the prior art, the refrigerated items 46 in the rear 22 of the case 20 are colder than the refrigerated items 48 in the front 24 of the case 20. This is because the rear 22 of the case 20 is adjacent the cooler 26 and the front 24 of the case 20 is open to the warmer store environment. Additionally, the product 50 in the middle and front 24 of the case 20 is generally warmer due to a loss in the air curtain 36 integrity related to the fan 38 location.

Figure 2:
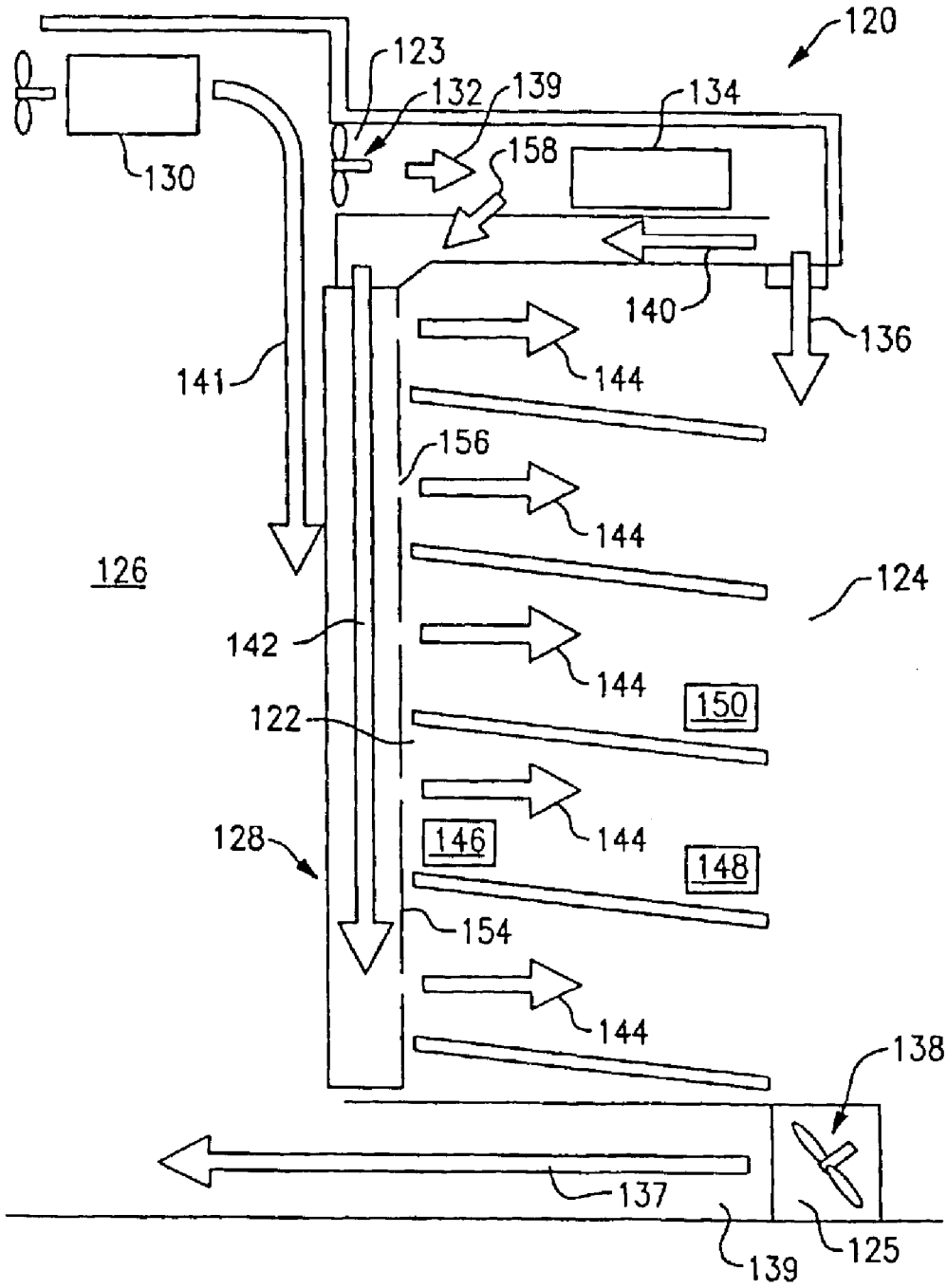
FIG. 2 schematically illustrates the refrigerated display case of the present invention.

FIG. 2 illustrates the refrigerated display case 120 of the present invention. Refrigerated items are stocked into the case 120 from the rear 122, allowing customers to access the refrigerated items from the front 124 of the case 120. The rear 122 of the case 120 is adjacent to a walk-in cooler 126 that keeps the refrigerated items fresh prior to being stocked in the case 120.

Air 141 circulated in the cooler 126 is cooled by a first coil 130, maintaining the desired temperature. Some of the air from the cooler 126 is drawn into the top 123 of the case 120 by fans 132 located at the top 123 and in the rear 122 of the case 120. Once the air has entered the case 120, the air 139 is further cooled by a second coil 134. Some of the cold air leaving the second coil 134 is discharged along the front 124 of the case 120 to create an air curtain 136 to cool the refrigerated items located in the front 124 of the case 120. Fans 138 at the bottom 125 and front 124 of the case 120 draws the air from the air curtain 136 into a return duct 159 for return of the air 137 to the cooler 126.

Some of the air 140 leaving the second coil 134 is channeled under the second coil 134 and directed to a duct 128 in the rear 122 of the case 120. The duct 128 extends down the length of the rear 122 of the case 120. The front 154 of the duct 128 has a plurality of openings 156 that allow air 144 to flow towards the front of the case 120 and across the refrigerated items. The number, size, and locations of the openings 156 depends on the size and placement of shelves in the case 120. The air 144 moving over the refrigerated items reduces the temperature of the refrigerated items 148 and 150 in the front 124 of the case 120 and assists in supporting the air curtain 136. The air 144 from the duct 128 also further cools the refrigerated items 150 in the middle and front 124 of the case. The duct 128 is moveable to allow for stocking of the case 120 from the rear 122.

The air 142 in the duct 128 is generally colder than the air in the air curtain 136. This is because the rear 122 of the case 120 is adjacent the cooler 126 and the front 124 of the case 120 is open to the warmer store environment. To prevent refrigerated items 146 in the rear 122 of the case 120 from freezing, air entering the duct 128 is tempered with air 158 that bypasses the second coil 134. This air 158 warms the air 142 in the duct 128, reducing the freezing of the refrigerated items 146 in the rear 122 of the case 120. As shown in FIG. 2, the air in the air curtain 136 flows in the same direction as the air 142 in the duct 128. That is the air in the air curtain 136 and the air 142 in the duct 128 both flow in the downwardly direction.

The display case 120 of the present invention reduces the temperature of the refrigerated items 148 in the front of the case 120 and achieves a tighter temperature range. Additionally, the refrigerated items in the front 124 of the case 120 are kept cool by the air flow 144 from the duct 128.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A refrigerated case comprising:

a first flow path of cool air directed along a front of said case;

a second flow path of cool air directed along a rear of said case wherein said first flow path of said cool air and said second flow path of said cool air flow in a common direction; and a cooling coil that cools a first portion of air drawn into said case, wherein said first portion of said air drawn into said case is directed to said first flow path and a second portion of said air drawn into said case bypasses said cooling coil and is directed to said second flow path.

2. The case as recited in claim 1 further including a first fan that draws said air into said case.

3. The case as recited in claim 2 further including a second fan located at a bottom of said front of said case, and said second fan draws said first flow path of cool air out of said case.

4. The case as recited in claim 1 wherein said first flow path is substantially parallel to said second flow path.

5. The case as recited in claim 1 further including at least one diverging path of cool air diverging from said second flow path of cool air and flowing towards said first flow path of cool air.

6. The case as recited in claim 1 wherein said second flow path of cool air travels downwardly along said rear of said case.

7. The case as recited in claim 6 wherein said first flow path of cool air travels downwardly along said front of said case.

8. The case as recited in claim 1 wherein said second flow path of cool air flows through a duct.

9. The case as recited in claim 2 further including a cooler compartment adjacent to said rear of said case and said first fan is located at a top of said rear of said case, and said first fan draws cool air from said cooler compartment into said case.

10. The case as recited in claim 8 wherein said duct includes at least one opening, and said cool air flows through said at least one opening to define at least one diverging path.

11. A refrigerated case comprising:

a first flow path of cool air directed along a front of said case;

a second flow path of cool air directed along a rear of said case and flowing through a duct;

at least one diverging path of cool air diverging from said second flow path of cool air and flowing towards said first flow path of cool air;

a cooler compartment adjacent to said rear of said case;

a fan located at a top of said rear of said case to draw air from said cooler compartment and into said case; and a cooling coil, and a first portion of said air drawn into said case by said fan is cooled by said cooling coil and directed to said first flow path and a second portion of said air drawn by said fan into said case from said cooler compartment bypasses said cooling coil and is directed to said second flow path.

12. The case as recited in claim 11 wherein said at least one diverging flow path is substantially perpendicular to said second flow path. 12.

13. The case as recited in claim 11 wherein said second flow path of cool air is warmed by said second portion of air that bypasses said cooling coil.

14. The case as recited in claim 11 wherein said first flow path of cool air and said second flow path of cool air flow in a common direction.

15. A method for refrigerating a case comprising the steps of:

cooling a first flow path of cool air with a cooling coil;

directing said first flow path of cool air along a front of said case;

bypassing a second flow path of cool air around said cooling coil;

directing said second flow path of cool air along a rear of said case, and wherein said first flow path of said cool air and said second flow path of said cool air flow in a common direction; and directing at least one diverging path of cool air from said second flow path of cool air and towards said first flow path of cool air.

16. A method for refrigerating a case comprising the steps of:

cooling a first flow path of cool air with a cooling coil;

directing said first flow path of cool air along a front of said case;

bypassing a second flow path of cool air around said cooling coil;

directing said second flow path of cool air along a rear of said case, and wherein said first flow path of said cool air and said second flow path of said cool air flow in a common direction;

directing at least one diverging path of cool air from said second flow path of cool air and towards said first flow path of cool air; and warming said second flow path of cool air by bypassing said second flow path of cool air around said cooling coil.

* * * * *

UNITED STATES PATENT AND TRADEMARK OFFICE

CERTIFICATE OF CORRECTION

PATENT NO. : 7,010,924 B2
APPLICATION NO. : 10/254291
DATED : March 14, 2006
INVENTOR(S) : Michael J. Kempiak It is certified that error appears in the above-identified patent and that said Letters Patent is hereby corrected as shown below:

Claim 1, Column 4, line 2: Please delete "and" and insert --at least one diverging path of cool air diverging from said second flow path of cool air and flowing towards said first flow path of cool air; a fan located at a top of said case to draw air into said case; and Claim 1, Column 4, line 3: Insert --said-- after "of"

Claim 1, Column 4, line 4: Insert --by said fan-- after "case"

Claim 1, Column 4, line 5: Insert -- wherein-- after "and"

Claim 1, Column 4, line 6: Insert --by said fan-- after "case"

Claim 2, Column 4, lines 9-10: Please delete "claim 2".

Claim 3, Column 4, line 11: "2" should be --1--

Claim 5, Column 4, lines 17-20: Please delete "claim 5".

Claim 9, Column 4, line 30: "2" should be --1--

Claim 12, Column 4, line 60: Please delete "12."

Claim 15, Column 5, lines 1-15: Please delete "claim 15".

Signed and Sealed this

First Day of May, 2007

JON W. DUDAS
*Director of the United States Patent and Trademark Office*